United States Patent [19]

Dudding

[11] Patent Number: 4,517,774

[45] Date of Patent: May 21, 1985

[54] WET BLASTING APPARATUS

[76] Inventor: Frank Dudding, 18, Lorraine St., Hull, England, HU8 8EG

[21] Appl. No.: 406,425

[22] Filed: Aug. 9, 1982

[30] Foreign Application Priority Data

May 4, 1982 [GB] United Kingdom ..... 8212760

[51] Int. Cl.[3] ..... B24C 7/00

[52] U.S. Cl. ..... 51/436; 51/319

[58] Field of Search ..... 51/410, 436, 319, 321, 51/438, 428; 222/57, 133; 417/401, 392; 92/13, 13.4, 13.41, 13.6

[56] References Cited

U.S. PATENT DOCUMENTS

| | | | |
|---|---|---|---|
| 1,186,485 | 6/1916 | McClelland | 417/401 |
| 2,376,616 | 5/1945 | Oechsle et al. | 51/438 |
| 2,671,462 | 3/1954 | Grier | 222/57 |
| 3,621,865 | 11/1971 | Baggaley | 417/401 |
| 3,690,067 | 9/1972 | Goss et al. | 51/428 |
| 3,729,168 | 4/1973 | Natho et al. | 92/13 |
| 3,963,383 | 6/1976 | Hill | 417/401 |

FOREIGN PATENT DOCUMENTS

| | | | |
|---|---|---|---|
| 1455913 | 11/1976 | United Kingdom | 51/438 |
| 1491596 | 11/1977 | United Kingdom | 51/436 |
| 1524769 | 9/1978 | United Kingdom | 51/436 |

*Primary Examiner*—Frederick R. Schmidt
*Assistant Examiner*—Robert A. Rose
*Attorney, Agent, or Firm*—William A. Drucker

[57] ABSTRACT

The invention provides an abrasive blasting system in which water is entrained in the compressed air stream used to carry the abrasive to act as a damper to prevent dispersion of the abrasive and surface debris after impact of the abrasive on the surface being treated. The abrasive and water feeds are controlled on dependence on the pressure of the source of compressed air so that all feeds are effected equally by fluctuations in the pressure. An additive may be metered into the water and adjustments are provided for controlling the ratio of additive and water and of water to abrasive.

24 Claims, 4 Drawing Figures

WET BLASTING APPARATUS

The present invention relates to abrasive/air blasting apparatus.

Dry abrasive blasting techniques, e.g. sand blasting, are well known and have been used for many years for cleaning or preparing surfaces for various purposes. They are capable of treating large areas relatively quickly, but they do have the disadvantage of producing a wide dispersion of the debris from the surface and of the dust formed by the abrasive particles after impact on the surface. In some circumstances, this may make it unfeasible to use the technique.

It is also known to blast surfaces with high-pressure water or air jets; the jets producing an abrasion of the surface due to the high pressure at which they are used; and these techniques generally avoid the disadvantage of the conventional dry blasting technique. However, they require apparatus capable of generating pressures of some thousands of pounds per square inch and they are not capable of treating large areas at an acceptable rate.

It is an object of the present invention to modify the conventional dry blasting technique to avoid the disadvantage of dispersion.

It is a further object to modify the conventional dry blasting technique also to improve the efficiency of that technique in the amount of abrasive that needs to be utilised.

It is also an object of the present invention to provide apparatus for abrasive/air blasting a surface, in which a damping liquid is entrained in a compressed air stream employed to carry the abrasive so as to distribute the liquid in the compressed air stream, whereby dust and debris arising from the blasting of the surface is substantially localised.

It is also an object of the present invention to provide such apparatus comprising a container for a liquid additive and a pump to pump the additive from the container to the damping liquid; the pump preferably being a variable displacement pump by variation of the stroke of which the ratio of additive to damping liquid can be varied: and it is a further object of the present invention to provide the variable displacement pump in a form which permits running adjustment of the stroke thereof.

It is also an object of the present invention to provide such apparatus in which the damping liquid and the abrasive feeds (and the additive feed, if additive is used) are made dependent on the source of compressed air so that any pressure fluctuation in that source affects all the feeds to an equal extent.

It is also an object of the present invention to provide such apparatus in which the damping liquid is pumped into the compressed air by a variable speed, pneumatically operated pump operated via a flow and pressure regulation means whereby running adjustment may be made to the pumping rate of the pump.

It is also an object of the present invention to employ the pneumatic exhaust from the variable speed pump to operate the variable displacement additive pump.

Briefly, the invention provides apparatus comprising a conduit through which a stream of compressed air is passed to a blast nozzle, a hopper for abrasive particles to deposit the particles into the compressed air stream in the conduit, the hopper being pressurized by a source of compressed air, a container for damping liquid and a pneumatically operated pump driven from said source of compressed air via a pneumatic motor to pump the liquid through an atomising orifice into the compressed air stream so as to distribute the liquid therein, whereby the jet of compressed air/abrasive leaving said nozzle and impinging on the surface to be treated is damped on impact and dust and debris arising from the blasting is substantially localised.

Usually the liquid will be water and, in many instances, this may make it desirable to use an additive with the liquid. For instance, in cleaning a painted metal surface down to the bare metal, it is desirable that the water should contain a corrosion inhibitor. It is preferred in the present invention that the additive and the water be fed from separate containers so that the proportions of the liquid and additive can be adjusted and that the additive be metered into the damping liquid to be fed into the compressed air stream by a pump driven by the pneumatic motor so that again any fluctuation in the pressure of the compressed air will affect the supply of additive in the way that it does the supply of abrasive and of the liquid. A presently preferred additive for use as a corrosion inhibitor is aqueous sodium nitrate.

The present invention will now be described, by way of example only, with reference to the accompanying drawings, in which.

Figure 1:
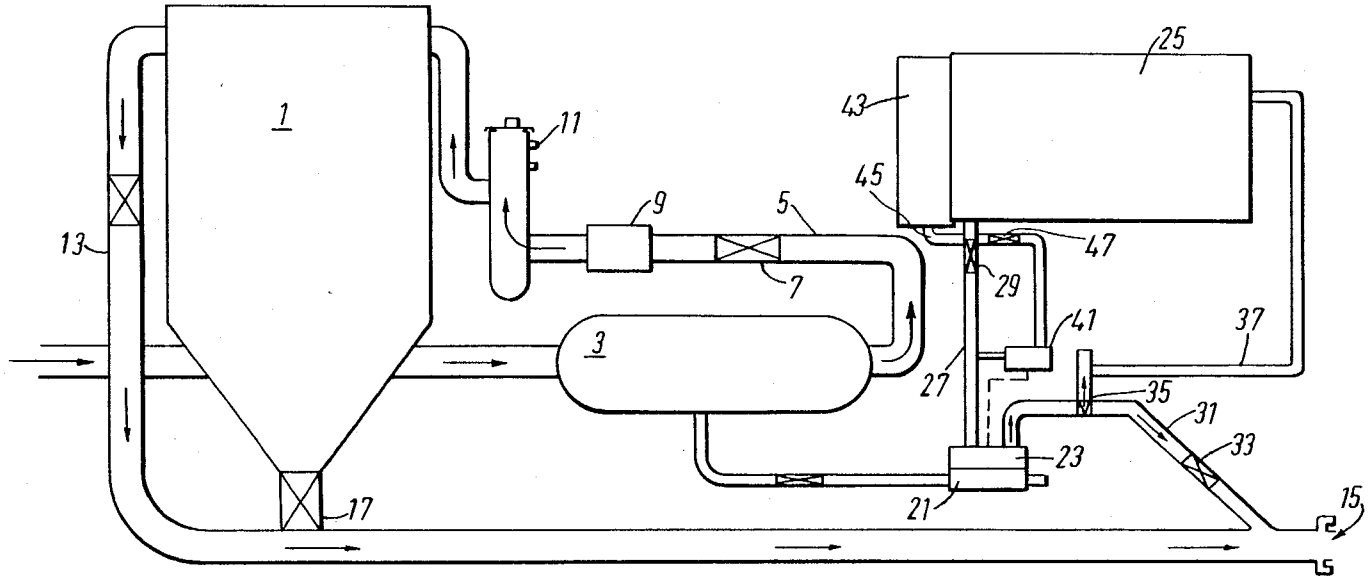
FIG. 1 is a diagrammatic sketch of an apparatus according to the invention.
Figure 2:
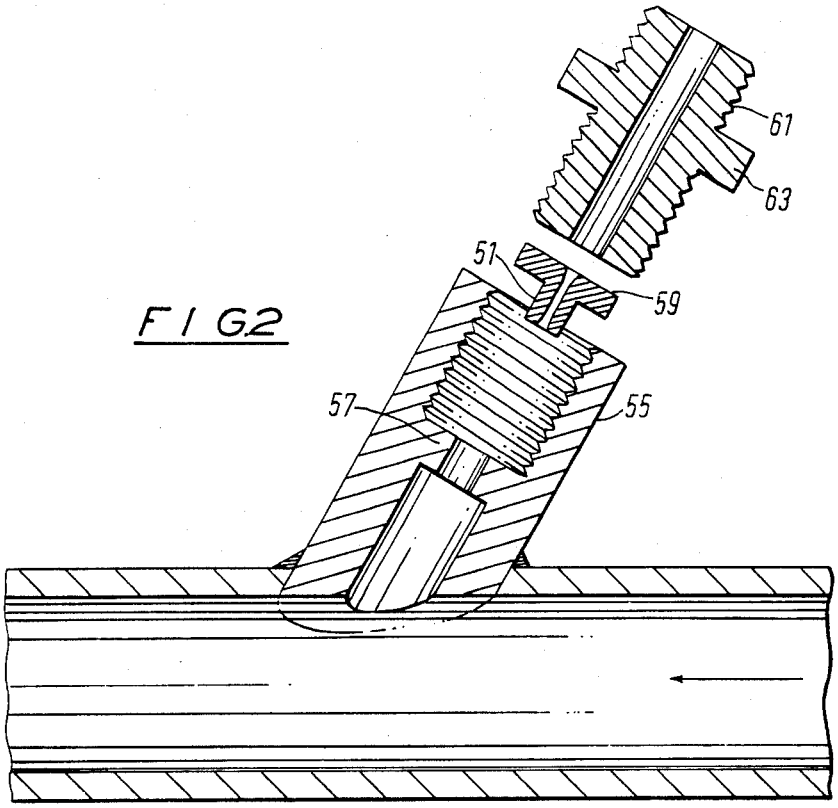
FIG. 2 is a sectional elevation of part of the apparatus of FIG. 1.
Figure 4:
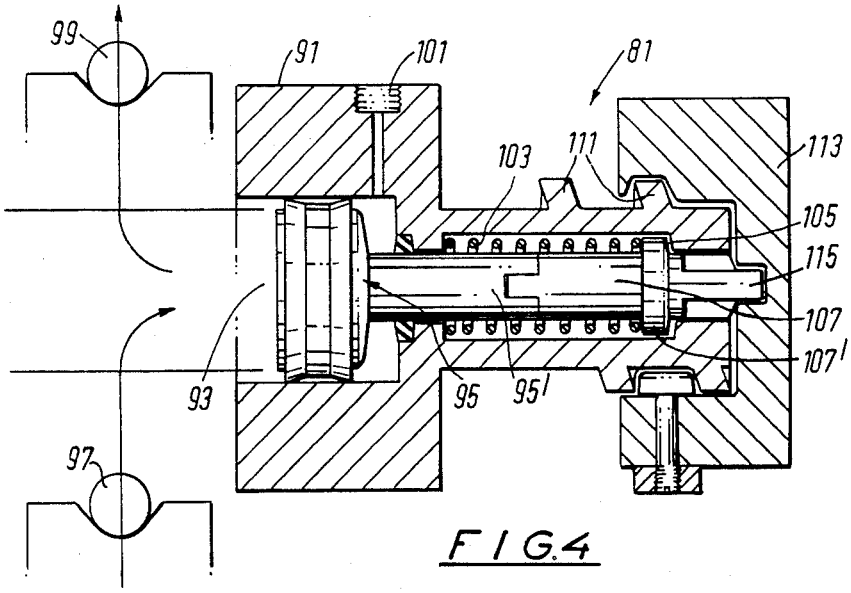
Figure 3:
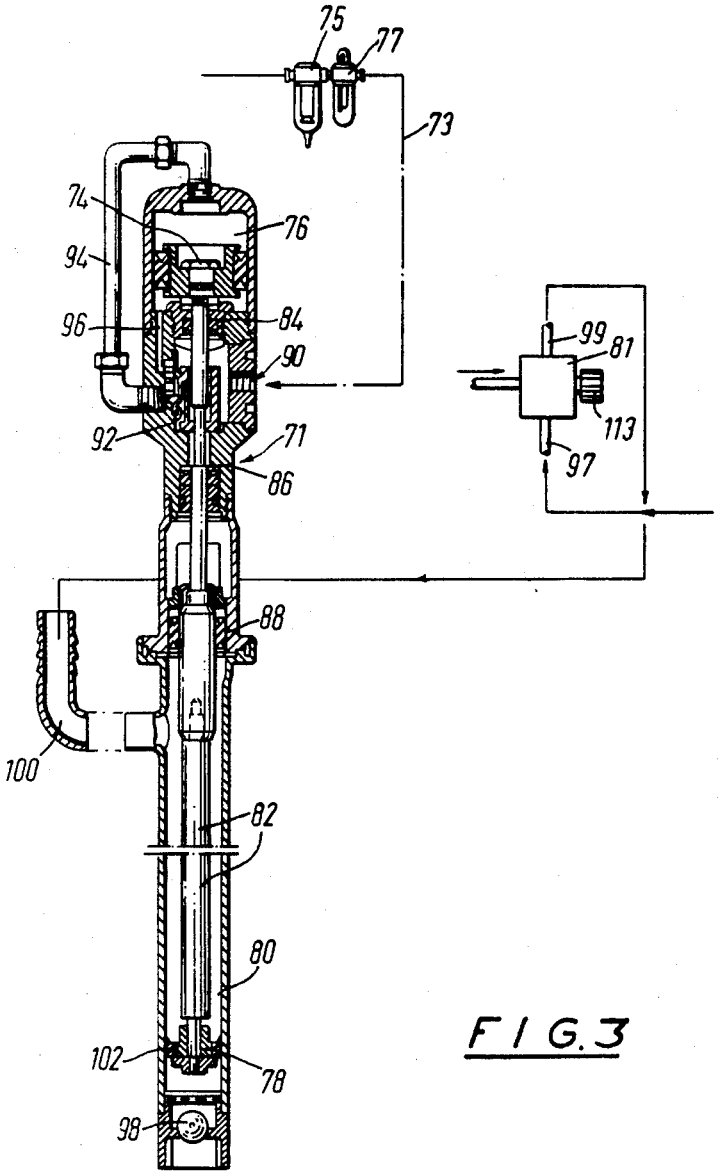

FIG. 3 relates to a modification of the embodiment of FIGS. 1 and 2 and shows the modification in diagrammatic elevation; and FIG. 4 shows, in section, a fragment of the modification of FIG. 3.

Referring now to the drawings, the apparatus comprises a hopper 1 for holding abrasive particles. The hopper receives a supply of compressed air from a compressor (not shown) via a pressure reservoir tank 3, a conduit 5, feed valve 7, air pressure control unit 9 and remote control safety valve 11. The compressed air pressurises the hopper, the hopper top being closed for this purpose, and passes from the hopper via conduit 13 to a blast outlet 15 to which a blast nozzle may be connected, for instance, by means of a flexible tube.

The bottom of the hopper opens into conduit 13 via a feed valve 17 so that abrasive particles fall from the hopper into the compressed air stream and are entrained therein.

The pressure reservoir tank is also connected to a pneumatic motor 21 which drives a water pump 23; the pump drawing water from a tank 25 via a conduit 27 and feed valve 29 and delivering water from the tank to a conduit 31 through which the water passes via a control valve 33, a non-return valve (not shown) and a nozzle (further described hereinbelow) into the conduit 13 by means of a "Y" joint formed between the conduits 31 and 13. By this means, the water is atomised and is distributed in the compressed air stream in conduit 13 over substantially the entirety of the cross section of the conduit. Between the water pump and the control valve installed in conduit 31, a relief valve 35 is provided connected by conduit 37 to the water tank so that water is fed back to the tank in the event that an excess pressure arises in conduit 31 upstream of the conduit control valve 33.

The pneumatic motor also drives a pump 41 drawing an additive from tank 43 via conduit 45 and control valve 47 installed therein and feeding the withdrawn additive into conduit 27 drawing water from the water tank.

As will be evident from the above, the rate of feed of the abrasive particles and the water and the additive is dependent on the pressure of the compressed air stream. Consequently, any variation in the pressure of the compressed air stream will affect the feed of those materials equally so that they are maintained in constant proportions in the compressed air stream exiting from the blast outlet. It will be understood that the gearing between the water pump and the additive pump will determine the ratio of water/additive feed for any given setting of control valves 29, 47.

Referring now to FIG. 2, the nozzle 51 provides a through passage 53 the cross section of which is considerably reduced in relation to the cross section of conduit 31 upstream of the nozzle so that the liquid passing through the nozzle is atomised and delivered into the conduit 13 in the form of a fine spray. The nozzle is supported in a nozzle holder 55, forming part of conduit 31, welded to conduit 13 at a suitable hole formed therein and providing an internal boss 57 on which seats an annular flange 59 formed on the body of the nozzle. Upstream of the internal boss, the nozzle holder is internally screw threaded; and the nozzle is held in place in the nozzle holder by an externally screw threaded nozzle retainer 61, also forming part of conduit 31, screwed into the nozzle holder. To facilitate screwing of the nozzle retainer, it is formed with an integral nut 63 to receive a suitable spanner.

The section of conduit 31 between the nozzle retainer and the one-way valve is formed by a flexible tube to make it convenient to install and remove the nozzle retainer.

An advantage of the illustrated apparatus is its flexibility in use. The feed rates of all the materials, that is, the compressed air, the abrasive particles, the water and, if used, the additive can be independently set to give whatever volumes are suitable for the job to be performed i.e. by adjustment of the hopper feed valve and the control valves 29, 33 and 47. The apparatus also permits the relative proportions of the materials to be maintained during operation in spite of any fluctuations in air pressure of the compressed air.

The additive to be used will be dependent on the particular job to be performed by the apparatus. If a metal surface is to be treated at least to the extent of exposing bare metal, the additive will be a corrosive inhibitor. Alternatively, it could be a detergent, for instance, if the treated surface needs to be freed from oil or grease, or a wood preservative if the surface to be treated is a wood surface, or a disinfectant if the surface to be treated is to be left sterile. It will be understood that it may be appropriate to use more than one additive, for instance, both a detergent and a corrosion inhibitor.

In an arrangement as above described, as intimated, running adjustments may be made by valves 29, 33 and 47 but with the valves commonly employed for this purpose, it may not be possible, in some instances at least, to determine the amounts to be metered with sufficient precision. Further, the commonly available liquid pumps suitable for use as the additive metering pump would not permit adjustment of the ratio in which the additive is metered in relation to the amount of water being used while the apparatus is working; nor would the pneumatic motor arrangement employed permit a running adjustment. A development of that embodiment, therefore, is intended to permit running adjustments to be made both to the quantity of water being pumped and the ratio in relation thereto of the additive, with requisite accuracy.

Turning now to FIGS. 3 and 4, in the modification the pneumatic motor and water pump are in the form of reciprocating piston devices and are housed in a common casing 71. The motor comprises a piston 74 housed in a cylinder 76 formed by the casing and the pump comprises a piston 78 housed in a cylinder 80 also formed by the casing; the two pistons being connected by a common piston rod 82 supported in bushes 84, 86, 88 mounted internally of the casing. The cylinder 76 below the bush 84 (as viewed in FIG. 3) forms a valve chamber receiving compressed air through input 90 via line 73, air pressure regulator 75 and air-flow regulator 77. The valve 92 in the chamber is a change-over-valve arrangement, in this instance, of a conventional trip type, which operates so that in one position, it ducts compressed air via an external line 94 to the top side of the piston and connects an internal bore 96 to an exhaust port (not visible in FIG. 3) to vent the underside of piston 74 in order to effect a downward stroke of the pump, and so that in a second position, it connects line 94 to the exhaust port to vent the top side of the piston 74 and ducts compressed air via bore 96 to the underside of the piston 74 to effect the up stroke of the pump. The surface area of the top side of the piston 74 is larger than the surface area of the bottom side of the piston 78, for instance in the ratio of 4.4:1, which enables the pump readily to maintain an adequate pumping rate of the water pump despite any fluctuations in the pressure of the compressed air precipitately dropping the pressure e.g. due to a poor compressor.

The water pump receives water from source via a ball valve 98 and discharges through conduit 100 connected to the pump cylinder; the pump piston comprising a flexible valve member 102 to admit water past the piston to flow thereabove on the down stroke of the piston but to force the water thus admitted above the piston through the conduit 100 and to induce a further amount of water through ball valve 98 on the up stroke of the pump.

The exhaust of air from the exhaust port of the pneumatic motor is used to drive the pump, in this instance, indicated by the reference numeral 81, for metering the additive. The additive pump draws additive from the container 43 as shown in FIG. 1 and the outlet of the pump is connected at a port (not shown in FIG. 3) to conduit 100 through which water is discharged from the water pump so that the conduit outputs a mixture of additive and water which is fed to the blast outlet in the manner described in connection with FIG. 1.

The pneumatic motor is intended to operate at a constant air pressure as determined by the airflow regulator; the value of the constant pressure being set by the air pressure regulator according to the work being carried out. Because of this, the pneumatic motor operates as a variable speed device the speed of which can be adjusted during operation simply by altering the value of the input pressure at the air pressure regulator i.e. as the input pressure is lowered the speed of the pump drops to lower the water pumping rate and, conversely, as the input pressure increases, the speed of the motor increases to increase the water pumping rate. Because the additive metering pump is fed from the exhaust from the pneumatic motor, its pumping rate is also determined by the pumping rate of the water pump. However, the ratio of the additive in relation to the amount of water being pumped is not determined solely by the speed of the operation of the pneumatic motor since the additive metering pump is arranged as a variable stroke device the stroke of which can be varied during operation of the pump. In this connection, reference is now made to FIG. 4. The additive metering pump comprises a casing 91 forming a cylinder 93 housing a piston 95 reciprocation of which sets the pump in action; the pump has an inlet 97 drawing additive in from the additive container and discharging the additive at an outlet 99. The casing comprises a bore 101 disposed radially of the axis of the piston to admit exhaust air from the pneumatic motor to the cylinder 93 to drive the piston on its forward stroke, that is, to the left as shown in FIG. 4; and the piston is returned by a spring 103 mounted around a rod 95' carried by the piston. The pump casing provides a chamber 105 disposed coaxially of the piston rod and housing the spring. The chamber forms a shoulder at the forward end thereof against which a respective end of the spring abuts, and the piston rod carries a plug 107 therein to provide at the rearward end of the rod an annular flange 107' extending radially of the piston rod and one face of which acts as an abutment for the other end of the spring. The opposite face of the flange abuts against a further shoulder formed by the chamber 105 at the rear end thereof; and, in the portion of the pump casing defining the chamber 105, an exterior thread 111 is formed on which is received a captive handle 113 so that by rotating the handle in one direction it is displaced axially forwardly and by rotation in the opposite direction it is displaced axially rearwardly. The plug secured to the piston rod is also formed with a rearwardly extending projection 115 abutting in a handle recess 117. Thereby, rotation of the handle to displace it forwardly moves the piston 95 to a more forward position against the bias of the spring and prevents the piston being drawn back beyond this position by the tension in the spring. It thereby shortens the stroke of the pump. Conversely, by rotating the handle to move it rearwardly, the piston 95 is drawn to a more rearward position under the spring bias, thereby lengthening the stroke of the pump. Because of the construction of the additive pump, this adjustment of the stroke can be effected quite readily during operation of the pump. Further, it not only permits a running adjustment to be made, but also permits a wide choice of ratio of additive to water for any given speed of the pneumatic motor.

With the arrangement as above-described, a considerable flexibility is provided in the choice of operating ratios of water to abrasive and of additive to water and it lends itself to remote control of these parameters or even automatic control as determined by a program.

Although the variable stroke additive pump as above-described, has proved to be an efficacious form of variable displacement pump it will be understood that the present invention is not limited to the provision of a running adjustment of the additive in this form, nor to the provision of a running adjustment of the water by means of the constant pressure pneumatic motor although, again, the motor and water pump combination as described has proved to be an efficacious one. It will also be understood that it is not being asserted that the above-mentioned modification resides in any way in the design per se of the pneumatic motor or the water pump, the design being largely conventional. However, the modification does reside, in part, in the choice of the motor and pump combination having the differential piston area, the mode of operating the pneumatic motor at a constant pressure and in feeding the additive feed pump from the exhaust of the pneumatic motor.

It will be evident to people skilled in the art that the described embodiments are capable of modifications, and it will be understood that all such modifications are within the spirit and scope of the present invention.

I claim:

1. Apparatus for abrasive blasting a surface, the apparatus comprising:

(a) means for forming a first stream of compressed air;
(b) means for forming a second stream of compressed air;
(c) means for supplying to the second stream of compressed air abrasive particles to entrain the abrasive particles in the second stream of compressed air;
(d) first pump means;
(e) means for supplying liquid to the first pump means;
(f) means for supplying the first stream of compressed air to the first pump means;
(g) second pump means;
(h) means for supplying an additive to the second pump means for pumping the additive to the liquid;
(i) means for supplying air from the first stream of compressed air supplied to the first pump means, to the second pump means to operate the second pump means; and
(j) means for supplying the first stream of compressed air entrained with liquid and additive, from the first pump means to the second stream of compressed air containing the entrained abrasive particles so as to permit compressed air, abrasive, liquid and additive to be directed through a blast nozzle.

2. Apparatus according to claim 1 wherein said second pump is a variable displacement pump.

3. Apparatus according to claim 2 wherein said second pump means comprises a piston formed with a piston rod housed in a housing·a part of which is disposed to act as a stop for the end of the piston rod remote from the piston; and wherein said housing is formed so that said part thereof can be displaced in a direction towards and away from the piston thereby to vary the stroke of the piston.

4. Apparatus according to claim 1 wherein said second pump means is a fluid-pressure operated pump operated by the fluid pressure solely on the force stroke of the pump; and wherein said housing contains a coiled spring mounted concentrically of said piston rod and arranged to effect the return stroke of the pump.

5. Apparatus for abrasive blasting a surface, the apparatus comprising:

(a) means for forming a first stream of compressed air;
(b) means for forming a second stream of compressed air;
(c) means for supplying to the second stream of compressed air abrasive particles to entrain the abrasive particles in the second stream of compressed air, said means for supplying abrasive particles comprising a hopper to hold a supply of abrasive particles, means for depositing abrasive particles from the hopper into the second compressed air stream and means for ducting the second compressed air stream into the hopper so as to force abrasive particles through said depositing means under pressure;
(d) first pump means;

(e) means for supplying liquid to the first pump means from a container for said liquid;
(f) means for supplying the first stream of compressed air to the first pump means;
(g) second pump means;
(h) means for supplying an additive to the second pump means for pumping the additive to the liquid;
(i) means for supplying air from the first stream of compressed air supplied to the first pump means, to the second pump means to operate the second pump means; and
(j) means to supply the first stream of compressed air entrained with liquid and additive, from the first pump means to the second stream of compressed air containing the entrained abrasive particles so as to permit compressed air, abrasive, liquid and additive to be directed through a blast nozzle.

6. Apparatus according to claim 5 further comprising a nozzle through which said liquid is pumped by said first pump means so as to atomize the liquid as it enters the first compressed air stream entrained with liquid and additive and so as to distribute the atomized liquid throughout the cross-section of the first compressed air stream.

7. Apparatus according to claim 5 wherein said means for ducting the second compressed air stream to said hopper is constituted by means for ducting compressed air from a source of compressed air to the hopper; whereby any fluctuation taking place in the pressure from the source of compressed air equally affects the amount of compressed air forming the compressed air stream, the amount of abrasive entrained therein and the amount of water entrained therein.

8. Apparatus according to claim 7 wherein the apparatus further comprises a container for the liquid additive and the second pump means in a pneumatically operated pump for pumping the liquid additive into the liquid to be entrained in the first compressed air stream; and wherein the apparatus further comprises means for operating the second pump means from the air from the first compressed air stream supplied to the first pump means.

9. Apparatus according to claim 8 wherein said means for operating the second pump means is constituted by means for feeding compressed air exhausted by the first pump means, whereby the operating speed of the second pump means is determined by the operating speed of the first pump means.

10. Apparatus according to claim 9 wherein the second pump means is a variable displacement pump, whereby, for any given operating speed of the second pump means, the ratio of additive to liquid metered by the second pump means can be varied by varying the displacement of the second pump means.

11. Apparatus according to claim 10 wherein the second pump means comprises a piston formed with a piston rod housed in a housing a part of which is disposed to act as a stop for the end of the piston rod remote from the piston; and wherein said housing is formed so that said part thereof can be displaced in a direction towards and away from the piston thereby to vary the stroke of the piston.

12. Apparatus according to claim 11 wherein the second pump means is a fluid-pressure operated pump operated by the fluid pressure solely on the force stroke of the pump; and wherein said housing contains a coiled spring mounted concentrically of said piston rod and arranged to effect the return stroke of the piston of the pump.

13. Apparatus according to claim 10 wherein the first pump means is a fixed displacement, variable speed, pneumatically operated pump, the speed of which, for any given pneumatic supply pressure, is dependent upon the back pressure against which the pump is working.

14. Apparatus according to claim 13 wherein the apparatus further comprises means for regulating the pneumatic supply to the first pump means so as to maintain the operating pressure of the first pump means at a predetermined and constant value.

15. Apparatus according to claim 14 wherein the first pump means comprises a first piston operating in a chamber and constituting an air motor and a second piston operating in a chamber and constituting a liquid pump; the first piston and the second piston being rigidly connected together so that the first piston drives the second piston via the rigid connection; and wherein the first piston has a substantially larger working surface area than has the second piston.

16. Apparatus for abrasive blasting a surface, the apparatus comprising:
(a) means for forming a first stream of compressed air;
(b) means for forming a second stream of compressed air;
(c) means for supplying to the second stream of compressed air abrasive particles to entrain the abrasive particles in the second stream of compressed air;
(d) first pump means comprising a variable speed, constant displacement pneumatically operated pump, the speed of which, for any given pneumatic feed pressure, is dependent on the back pressure against which the pump is operating;
(e) means for supplying liquid to the first pump means;
(f) means for supplying the first stream of compressed air to the first pump means;
(g) second pump means;
(h) means for supplying an additive to the second pump means for pumping the additive to the liquid;
(i) means for supplying air from the first stream of compressed air supplied to the first pump means, to the second pump means to operate the second pump means; and
(j) means for supplying the first stream of compressed air entrained with liquid and additive, from the first pump means to the second stream of compressed air containing the entrained abrasive particles.

17. Apparatus according to claim 16 wherein the first pump means comprises a first piston operating in a chamber and constituting an air motor and a second piston operating in a chamber and constituting a liquid pump; the first piston and the second piston being rigidly connected together so that the first piston drives the second piston via the rigid connection; and wherein the first piston has a substantially larger working surface area than has the second piston.

18. Apparatus according to claim 17 wherein the area of the working surface of the first piston to that of the second piston is in the ratio of 4.4:1.

19. Apparatus according to claim 17 wherein the second pump means comprises a pneumatically operated, variable displacement pump.

20. Apparatus according to claim 19 wherein said variable displacement pump is operated by the exhaust from the first pump means.

21. Apparatus according to claim 19 wherein the second pump means comprises a piston formed with a piston rod housed in a housing a part of which is disposed to act as a stop for the end of the piston rod remote from the piston; and wherein said housing is formed so that said part thereof can be displaced in a direction towards and away from the piston thereby to vary the stroke of the piston.

22. Apparatus according to claim 21 wherein the second pump means is a fluid-pressure operated pump operated by the fluid pressure solely on the force stroke of the pump; and wherein said housing contains a coiled spring mounted concentrically of said piston rod and arranged to effect the return stroke of the piston of the pump.

23. Apparatus according to claim 21 wherein said part of said housing is manually positionable.

24. Apparatus according to claim 23 wherein said housing of the second pump means comprises a cylindrical portion housing said piston rod and the cylindrical portion is externally screw threaded; and wherein said manually positionable part of said housing comprises a cap having an internally screwable-threaded skirt received on the screw thread of said cylindrical portion of the housing; whereby said part of the housing may be displaced in a direction towards and away from said piston by rotation of the cap on said cylindrical portion of the housing.

* * * * *